US010648249B2

(12) United States Patent
Varkey

(10) Patent No.: US 10,648,249 B2
(45) Date of Patent: May 12, 2020

(54) DEPLOYMENT AND RETRIEVAL SYSTEM FOR ELECTRIC SUBMERSIBLE PUMPS

(71) Applicant: Schlumberger Technology Corporation, Sugar Land, TX (US)

(72) Inventor: Joseph Varkey, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 384 days.

(21) Appl. No.: 14/890,568

(22) PCT Filed: May 9, 2014

(86) PCT No.: PCT/US2014/037444
§ 371 (c)(1),
(2) Date: Nov. 11, 2015

(87) PCT Pub. No.: WO2014/186221
PCT Pub. Date: Nov. 20, 2014

(65) Prior Publication Data

US 2016/0186507 A1 Jun. 30, 2016

Related U.S. Application Data

(60) Provisional application No. 61/822,358, filed on May 11, 2013.

(51) Int. Cl.

| | |
|---|---|
| ***E21B 19/08*** | (2006.01) |
| ***E21B 19/22*** | (2006.01) |
| ***E21B 43/12*** | (2006.01) |

(52) U.S. Cl.
CPC ..... *E21B 19/08* (2013.01); *E21B 19/22* (2013.01); *E21B 43/128* (2013.01)

(58) Field of Classification Search
CPC ..... E21B 19/08; E21B 19/22; E21B 43/128
See application file for complete search history.

(56) References Cited

U.S. PATENT DOCUMENTS

| | | | | |
|---|---|---|---|---|
| 4,899,823 A | | 2/1990 | Cobb et al. | |
| 5,361,834 A | | 11/1994 | Cox | |
| 5,853,118 A | * | 12/1998 | Avakov | B65G 37/005 226/173 |

(Continued)

OTHER PUBLICATIONS

European Search Report issued in related EP application 14797736.7 dated Mar. 29, 2016, 4 pages.

(Continued)

*Primary Examiner* — Matthew R Buck
*Assistant Examiner* — Aaron L Lembo

(57) ABSTRACT

Representative implementations of devices and techniques provide a system arranged to deploy and retrieve a device such as an electric submersible pump with respect to a well or other like formation. An injection device for coiled tubing is modified to grip and inject a cable in order to lower a pump or like device into a wellbore. Modification to the tube injection device may include addition of cable-gripping blocks to the injection components. Multiple injection devices can be utilized to open and close in coordination in order to let a large connector or termination on the cable pass through an open injector while a closed injector maintains a grip on the cable.

20 Claims, 17 Drawing Sheets

(56) References Cited

U.S. PATENT DOCUMENTS 6,082,454 A * 7/2000 Tubel ..... E21B 17/20 166/250.15
6,116,345 A 9/2000 Fontana et al.
6,192,983 B1 * 2/2001 Neuroth ..... E21B 17/028 166/250.15
6,276,454 B1 8/2001 Fontana et al.
6,896,056 B2 * 5/2005 Mendez ..... E21B 47/0905 166/254.2
6,923,273 B2 * 8/2005 Terry ..... G01V 3/30 138/125
8,220,553 B2 * 7/2012 Crawford ..... E21B 33/072 166/241.5
8,789,585 B2 * 7/2014 Leising ..... E21B 47/00 166/250.01
8,857,520 B2 * 10/2014 Hoffman ..... E21B 33/038 166/338
9,145,761 B2 * 9/2015 Hallundbæk ..... E21B 41/04
9,297,220 B2 * 3/2016 Beck ..... E21B 19/004
9,631,442 B2 * 4/2017 Bansal ..... E21B 17/01
2002/0079108 A1 * 6/2002 Headworth ..... E21B 17/01 166/384
2005/0189116 A1 9/2005 See
2005/0247454 A1 * 11/2005 Domann ..... B66D 3/003 166/380
2009/0272520 A1 11/2009 Hug et al.
2009/0308618 A1 * 12/2009 Collie ..... E21B 17/1035 166/385
2011/0308816 A1 * 12/2011 Chalifoux ..... E21B 33/068 166/381
2012/0085531 A1 * 4/2012 Leising ..... E21B 47/00 166/77.2
2012/0222855 A1 9/2012 Chartier et al.
2013/0048270 A1 * 2/2013 Havinga ..... E21B 19/22 166/66
2013/0098025 A1 * 4/2013 Havinga ..... E21B 19/22 60/445
2013/0112433 A1 5/2013 Armstrong et al.
2013/0175048 A1 * 7/2013 Goode ..... E21B 19/08 166/379
2014/0048277 A1 * 2/2014 June ..... E21B 33/035 166/348
2016/0069478 A1 * 3/2016 Mackinnon ..... F16L 1/23 405/168.4
2017/0260817 A1 * 9/2017 Dobkins ..... E21B 19/08

OTHER PUBLICATIONS

Office Action issued in related EP application 14797736.7 dated Apr. 13, 2016, 5 pages.

* cited by examiner

DEPLOYMENT AND RETRIEVAL SYSTEM FOR ELECTRIC SUBMERSIBLE PUMPS

RELATED APPLICATIONS

This patent application claims the benefit of priority to U.S. Provisional Patent No. 61/822,358 to Varkey, filed May 11, 2013 and incorporated herein by reference in its entirety.

BACKGROUND

Various techniques may be used to deploy and/or retrieve equipment, such as electric submersible pumps (ESP's) used in the oil and gas industries, with regard to subsurface wells and other like formations. In such applications, the equipment may be lowered into the well or retrieved via a system of cables and pulleys, for example. In some cases, the weight of the equipment with respect to the cables used, or the use of power and telemetry conductors along with equipment can limit the efficiency or success of such systems.

For example, in some cases, cables may be prone to failure due to insufficient strength. While some advances have been made in cable technology, high stress points can occur at some locations, including at the drum from which the cable is delivered and at sheaves that guide the cable down the hole. Cable failure can occur at the high stress points. For instance, during deployment and recovery, the greatest stress placed on cables can occur as the cable passes over a sheave under load.

Further, other types of failures can occur from fluid intrusion into the cables or from "z-kinking," when there is too much slack present in electrical and telemetry conductors causing the conductors to be kinked as the equipment is deployed.

BRIEF DESCRIPTION OF THE DRAWINGS

The detailed description is set forth with reference to the accompanying figures. In the figures, the left-most digit(s) of a reference number identifies the figure in which the reference number first appears. The same numbers are used throughout the figures to reference like features and components.

For this discussion, the devices and systems illustrated in the figures are shown as having a multiplicity of components. Various implementations of devices and systems, as described herein, may include fewer components and remain within the scope of the disclosure. Alternately, other implementations of devices and systems may include additional components, or various combinations of the described components, and remain within the scope of the disclosure.

DETAILED DESCRIPTION

Introduction

Figure 1:
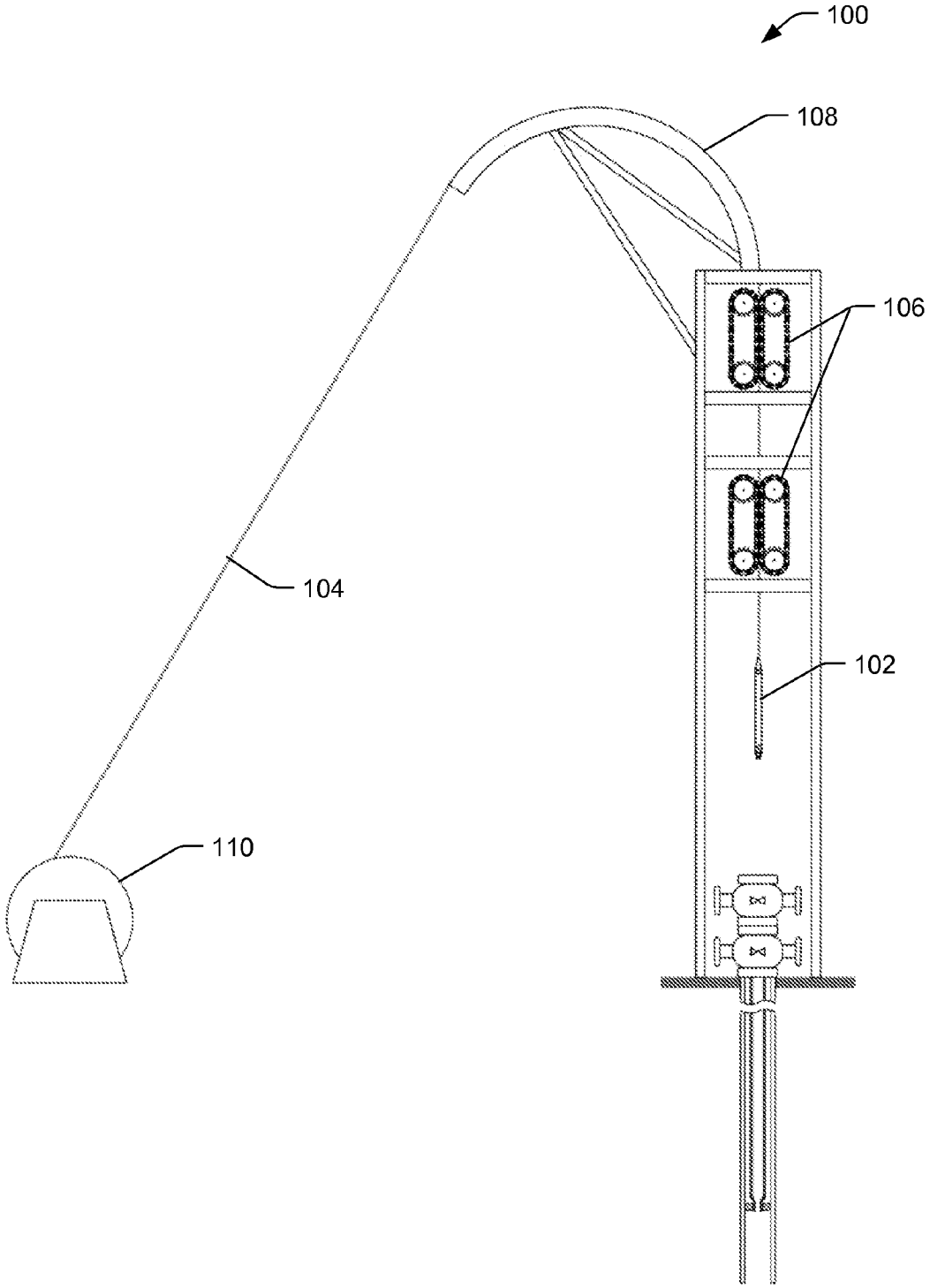
FIG. 1 is a diagram of an example environment wherein the techniques and devices described herein may be applied.

Representative implementations of devices and techniques provide a system arranged to deploy or retrieve a device such as an electric submersible pump (ESP) with respect to a well, a hole, or other like formation. In an embodiment, a deployment and retrieval system uses a single cable with one or more conveyance components.

In an implementation, an injection device conventionally configured for injecting coiled tubing is arranged or modified to grip and inject a single cable attached to an ESP, or like device. For example, in an embodiment, the tube injection device is modified to include cable-gripping blocks, designed to work with cable-size diameters, at the injection components. In another implementation, two or more modified injection devices are used to deploy or retrieve the ESP, using a single cable.

In various implementations, the injectors are opened and closed according to raising and lowering schemes to allow terminations, connectors, and so forth, to pass through the injectors while at least one of the injectors maintains a grip on the cable. The opening and closing of the injectors may be coordinated during deployment or retrieval of the ESP to hold the cable in place or to move the cable in or out of the well or hole. For example, terminations or other ESP components may be too large to pass through a closed injector that is sized to grip a cable. As one injector opens to allow a termination to pass through the injector, one or more other injectors remains closed or actively closes to hold the cable in place or to move the ESP in or out of the hole.

In an implementation, a length of cable attached to the ESP is terminated when the ESP is in a down-hole position. The termination can be arranged to hang the cable in tension to prevent kinking of ESP conductors and the like. One or more spacers may be inserted into the system, at the cable termination, to reduce or remove slack in the terminated cable. As the cable stretches over time, additional or alternate spacers may be used to take up the slack in the cable. In one implementation, the spacers may be adjusted to take up the slack as desired over time.

In an implementation, sensors are employed that allow the terminated cable length to be set with sufficient precision to avoid excessive slack in the cable at the ESP tool string, preventing the cable from become kinked and damaged. For example, a processing device may be used with the sensors, for determining the length of the cable based on data (e.g., cable tension, weight of components, etc.) received from the sensors.

In one example embodiment, the deployed ESP and terminated cable can be efficiently pulled out of the hole using a lead-in cable fitted with a connection that is field-attached to an up-hole termination of the ESP cable.

Advantages of the disclosed techniques and devices are varied. In various implementations, the described techniques allow the weight of the cable and ESP tool string (and associated ESP components) to be borne in a straight line, reducing stress points in the cable, and reducing cable failure. Example systems or methods may also provide some or all of the following advantages:

- Stress is not placed on the cable as it passes over sheaves.
- Terminator joints can be passed through the injectors without removing gripping blocks.
- Cable can be precisely cut to the correct length by using one or more sensors (such as a load cell, for example) at the tool end to determine proper cable tension.
- Cable can be deployed with almost no slack.
- Cable can be deployed pre-terminated at the top and bottom ends.
- Other advantages of the disclosed techniques may also be present.

Various implementations and embodiments for deployment and retrieval systems, devices, and techniques are discussed in this disclosure. These features, systems, and methods represent possible implementations and are included for illustration purposes and should not be construed as limiting. Moreover, different implementations can include all or different subsets of aspects described below and further embodiments and examples may be possible by combining the features and elements of individual embodiments and examples. The aspects described below may be included in any order, and numbers or letters placed before various aspects are done for ease of reading and in no way imply an order, or level of importance to their associated aspects.

The techniques and devices are discussed with reference to example deployment and retrieval systems and devices illustrated in the figures. However, the illustrations are not intended to be limiting, and are for ease of discussion and illustrative convenience. The techniques, systems, and devices discussed may be applied to many various deployment and retrieval system designs, structures, and the like, and remain within the scope of the disclosure. Further, the references to ESPs, pumps, or like equipment are applicable to and intended to include many devices, components, or systems that can be deployed and retrieved in a substantially vertical manner, whether subsurface or above the surface of the earth, a body of water, or the like. For convenience, the terms "ESP" and "pump" used herein also refers to numerous such articles that may be raised or lowered, e.g., in a wellbore.

Example System

FIG. 1 is a diagram of an example system 100 wherein the techniques and devices described herein may be applied. For example, the system 100 may be arranged to deploy and retrieve an ESP 102, as described above. In an implementation, an example system 100 uses an ESP cable 104 (i.e., a single cable) with a pre-terminated connector 302 ("termination," see FIGS. 3 and 4), and uses injectors 106, for example, injectors similar to those used with coiled tubing. In an implementation, the injectors 106 are modified for use with the smaller diameter of an ESP cable 104 (hereinafter, "cable") as compared to the diameter of a conventional coiled tubing. The cable 104 is threaded, for example, over a gooseneck 108 and through one or more of the injectors 106. The injector(s) 106 can grip the cable 104, and lower or raise the ESP 102 via the cable 104.

In alternate implementations, various quantities of injectors 106 may be used with a system 100. In the illustrations, a system 100 having two injectors 106 is shown. However, this is not intended to be limiting, and a system 100 may have a single injector, or may have three or more injectors and remain within the scope of the disclosure.

The cable 104 may be wound on a spool 110, for convenience. In some embodiments, the spool 110 may provide some pulling force to assist the injectors 106 in raising or lowering the ESP 102. In other embodiments, the spool may be arranged to take up or dispense the cable 104, and not be arranged to support the weight of the ESP 102.

Example Deployment

Figure 2:
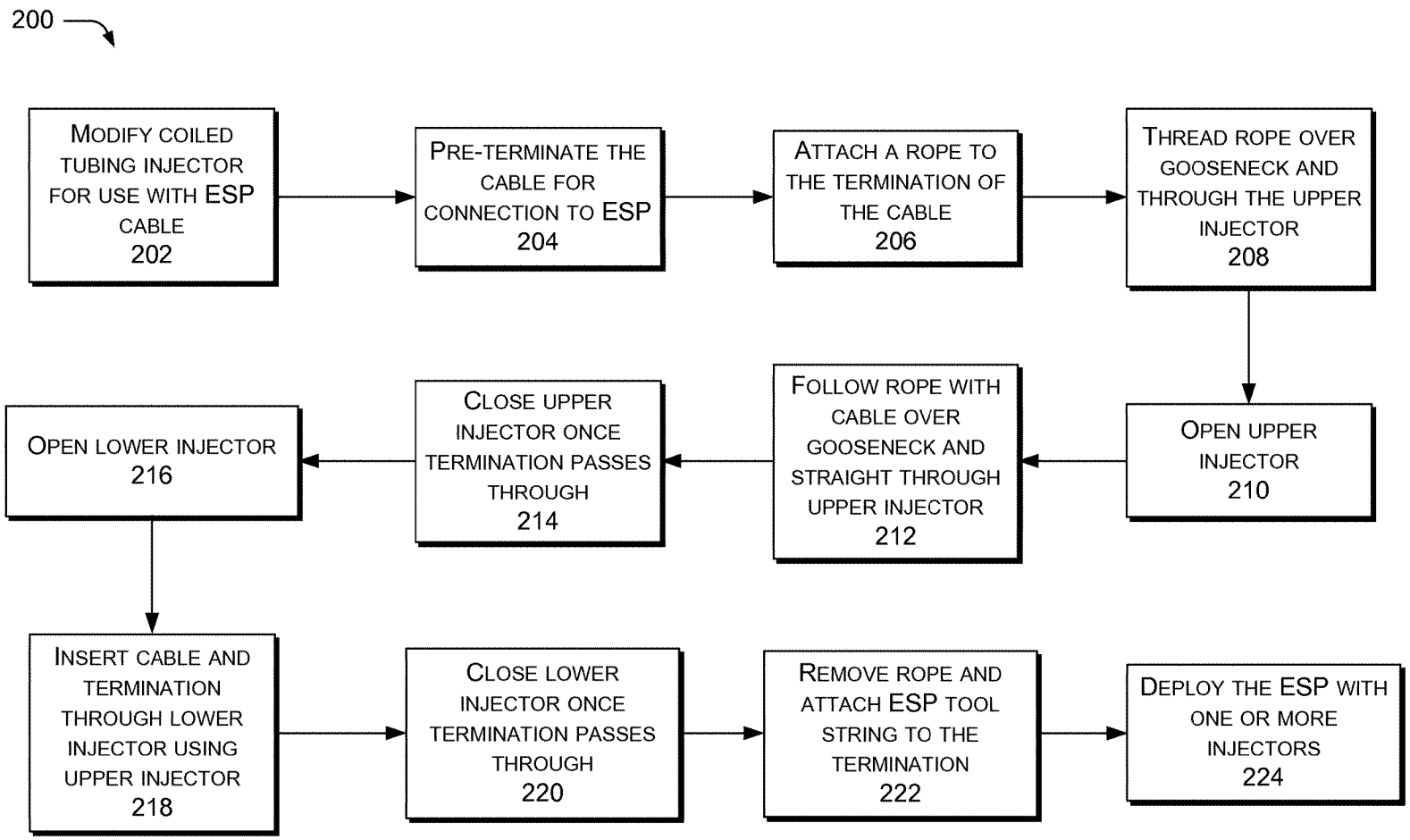
FIG. 2 is a flow diagram showing an example technique for deploying an ESP, or other equipment, according to an embodiment.
Figure 3:
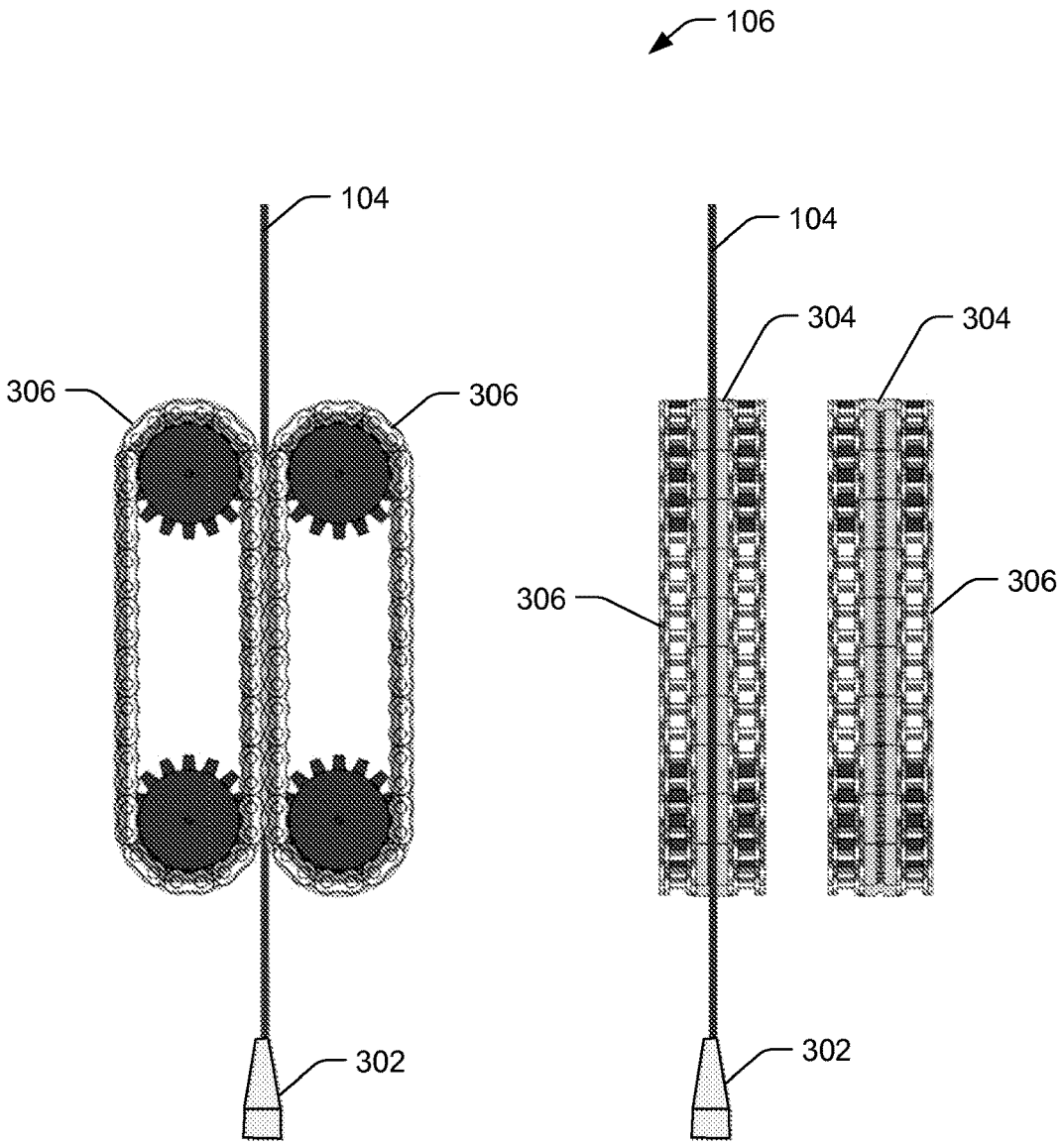
FIG. 3 is a diagram of an example tube injector modified to deploy an ESP on a cable, according to an embodiment.

In an example implementation, a system 100 may be used to deploy an ESP 102 (or other device) into a well, or other formation, as described in the flow chart of FIG. 2. As shown in FIG. 2, at block 202, an injector 106 is modified for use with a cable 104. For example, FIG. 3 shows multiple illustrative views of an example injector 106 that has been modified to include one or more gripper blocks 304 sized to grip a cable 104. In an implementation, the gripper blocks 304 are arranged to reduce a gripping diameter of each coiled tubing injector 106 from a first gripping diameter suitable for coiled tubing to a second gripping diameter suitable for the cable 104. In various implementations, the gripper blocks 304 may include various friction features on gripping surface(s) and may be constructed to firmly grip a cable such as cable 104, or the like.

As shown in FIG. 3, an injector 106 may include a set of drive mechanisms 306 arranged to move the gripper blocks 304, as they grip the cable 104, so that the cable 104 is raised or lowered with respect to the injectors 106. In alternate implementations, the drive mechanisms 306 may have various configurations with various components, including pulleys, gears, chains, belts, tensioners, and the like.

In an implementation, the drive mechanisms 306 include (or are coupled to) a power source (not shown) connected to the injectors 106 for either lowering the cable 104 into a wellbore to install at least a component of an ESP 102 or for raising the cable 104 from the wellbore to retrieve at least a component of the ESP 102. For example, the power source may include a mechanical drive assembly, a pneumatic, hydraulic, or electric motor, cylinder, or solenoid, or another device or system (including combinations of the above) arranged to provide a desired force.

In an implementation, as shown in FIG. 2, at block 204 and in FIG. 3, the cable 104 includes a connector 302 (i.e., termination) attached to the cable 104 for releasably securing at least a component of the ESP 102. In an embodiment, the cable is pre-terminated with the connector 302 prior to deploying the ESP 102. For example, the ESP 102 may be field-connected to the connector 302 in preparation for deploying the ESP 102. Alternately, the ESP 102 may be field-disconnected from the connector 302 after retrieving the ESP 102 from the well.

Figure 4:
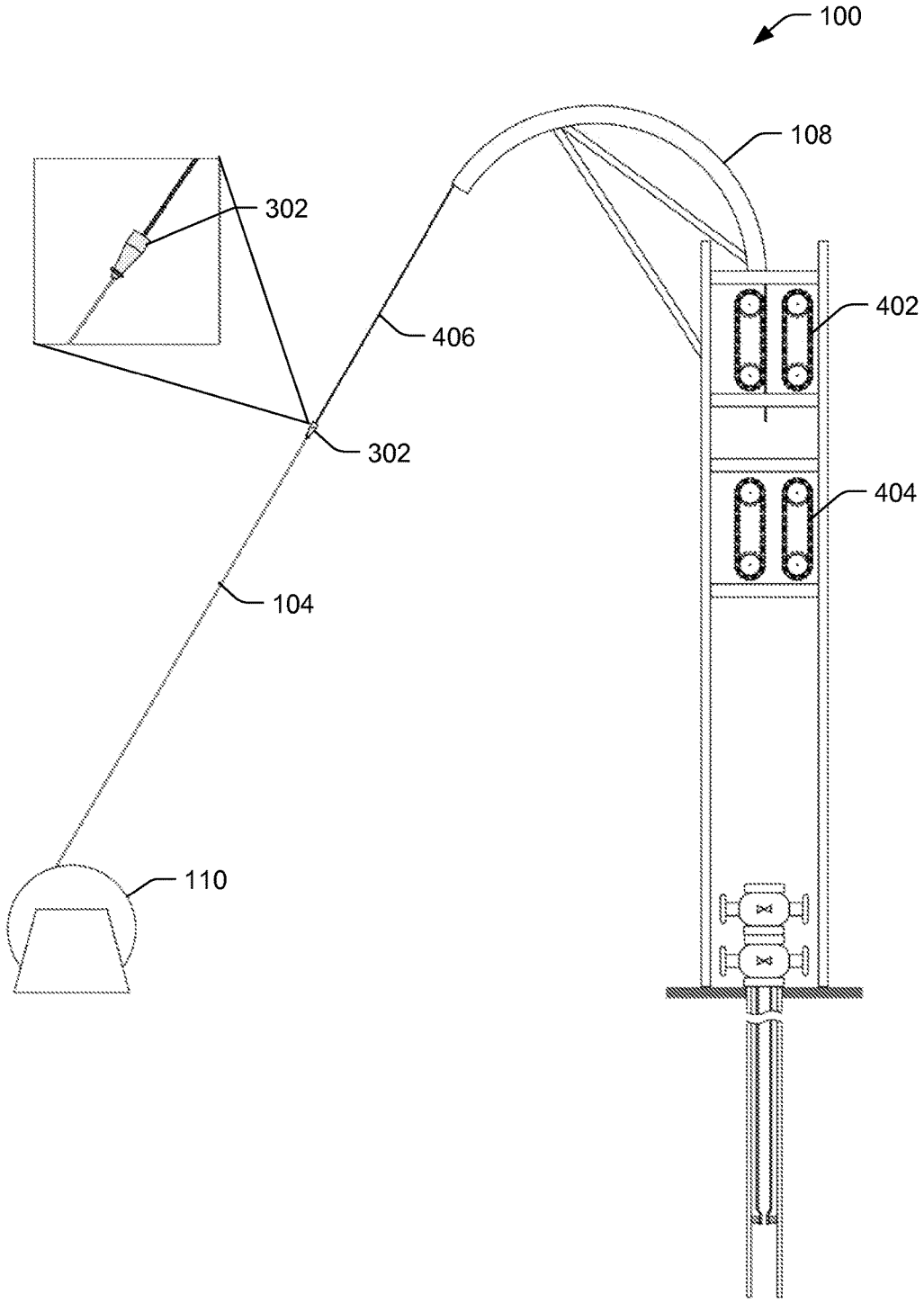
FIG. 4 is a diagram showing a lead-in technique and open injectors for initiating a cable to deploy an ESP, for example.

In an implementation, as shown in FIG. 4, multiple injectors 402 & 404 may be positioned one above the other, such that the cable 104 and the ESP 102 (FIG. 1) are raised and lowered in a vertical orientation. In such an implementation, a lower injector 404 may be positioned directly below an upper injector 402. Further, the upper 402 and lower 404 injectors can be coordinated to raise and lower the cable 104 and thus, the ESP 102 (FIG. 1). For example, at least one of the multiple injectors 402 & 404 may be closed on the cable 104 while one or more of the injectors (e.g., 402 & 404) are open to allow an oversized object (e.g., a connector 302, a termination, etc.) to pass through the injector 402 or 404.

In an implementation, as shown in FIG. 2, at blocks 206 and 208, and in FIG. 4, a length of rope 406, for example, can be temporarily attached to the connector 302 and threaded over the gooseneck 108 to help guide the connector 302 over the gooseneck 108 and straight through the upper injector 402. In an implementation, each of the injectors 402 & 404 has an openable gripping mechanism (e.g., components 304 & 306 in FIG. 3) to allow the connector 302 to temporarily pass through a given coiled tubing injector 402 or 404 when the coiled tubing injector 402 or 404 is open. At block 210, the upper injector 402 is opened (or remains open if previously opened) to make room for the connector 302 to pass through the upper injector 402, when the connector 302 is too large to fit through the closed upper injector 402.

At block 212 (FIG. 2), the connector 302 and the cable 104 follow the rope 406 over the gooseneck 108 and straight through the upper injector 402. The upper injector 402 is left open until the connector 302 passes through, and is then closed onto the cable 104 at block 214. The upper injector 402 then has traction and can be used to convey the cable 104 downward. At block 216, the lower injector 404 is opened (or remains open if previously opened) to make room for the connector 302 to pass through the lower injector 404. The upper injector 402 conveys the connector 302 and the cable 104 through the open lower injector 404, at block 218. At block 220, once the connector 302 passes through the lower injector 404, the lower injector is closed onto the cable 104.

In an example, at block 222, the rope 406 is removed from the connector 302 and the ESP 102 (and associated tool string) is attached to the connector 302. At block 224, one or more of the injectors 402 & 404 convey the ESP 102 into the wellbore 502 (or other formation).

Figure 5:
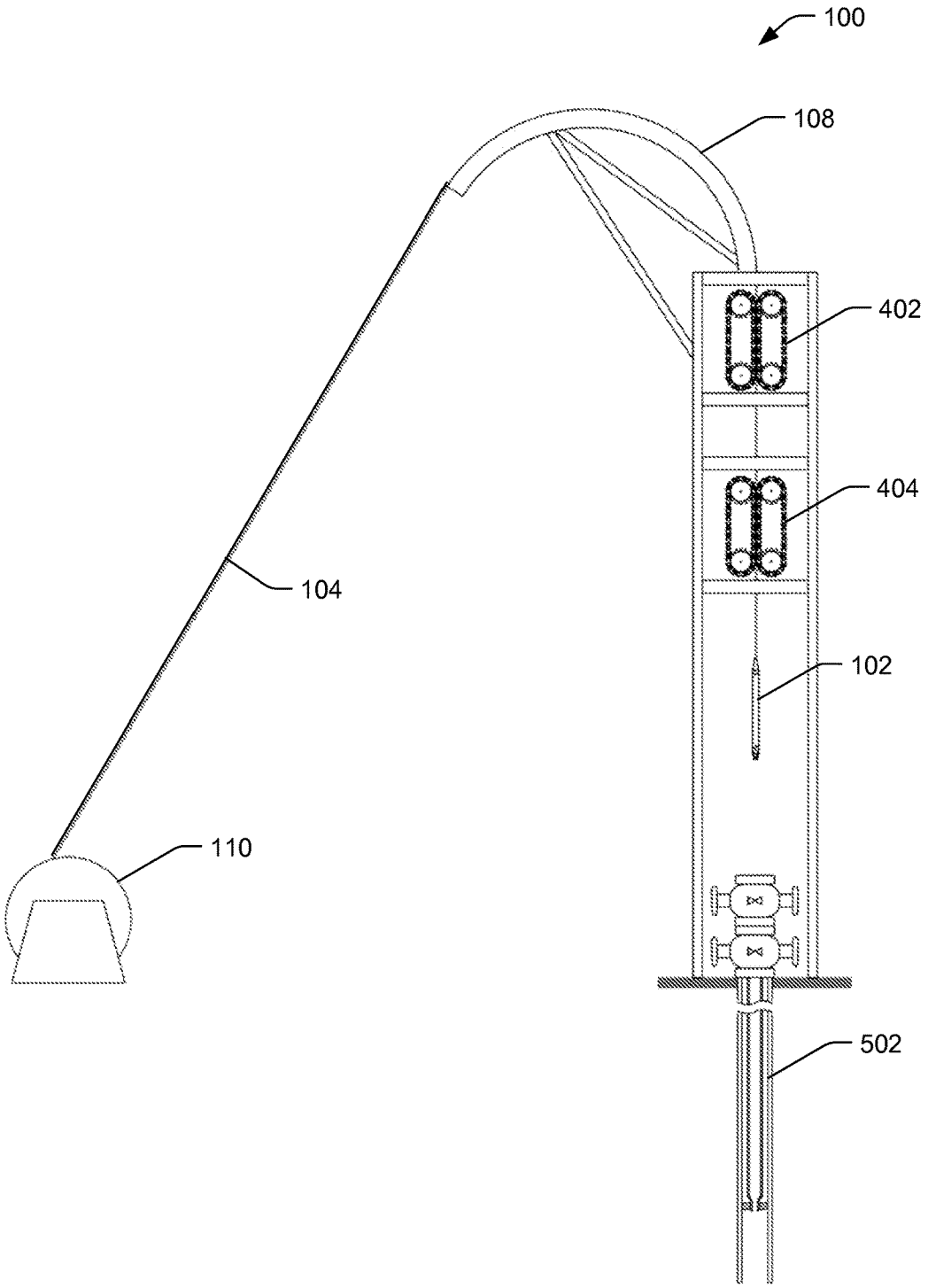
FIG. 5 is a diagram showing closed injectors and ESP attached to a cable by a connector for an example ESP deployment system.

In an implementation, as shown in FIG. 5, the ESP 102 is conveyed by the injector(s) 402 & 404 in a vertical manner, with the ESP 102 hanging on the cable 104 from the grip-blocks 304 of the injector(s) 402 & 404. In this configuration, the weight of the ESP 102 and associated components is borne in a straight vertical line by the injector(s) 402 & 404 and the cable 104, reducing high stress points in the cable 104, and preventing associated cable 104 failure.

As further shown in FIG. 5, in an implementation, the gooseneck 108 is shaped with a large enough radius to distribute the weight of the ESP 102 and related components over a large area of the gooseneck 108, in case the injector(s) 106 are open, and the spool 110 is left to support the weight of the ESP 102. Shaping the gooseneck 108 with a large radius avoids concentrated high-stress points on the cable 104, and reduces associated cable 104 failure.

Figure 6:
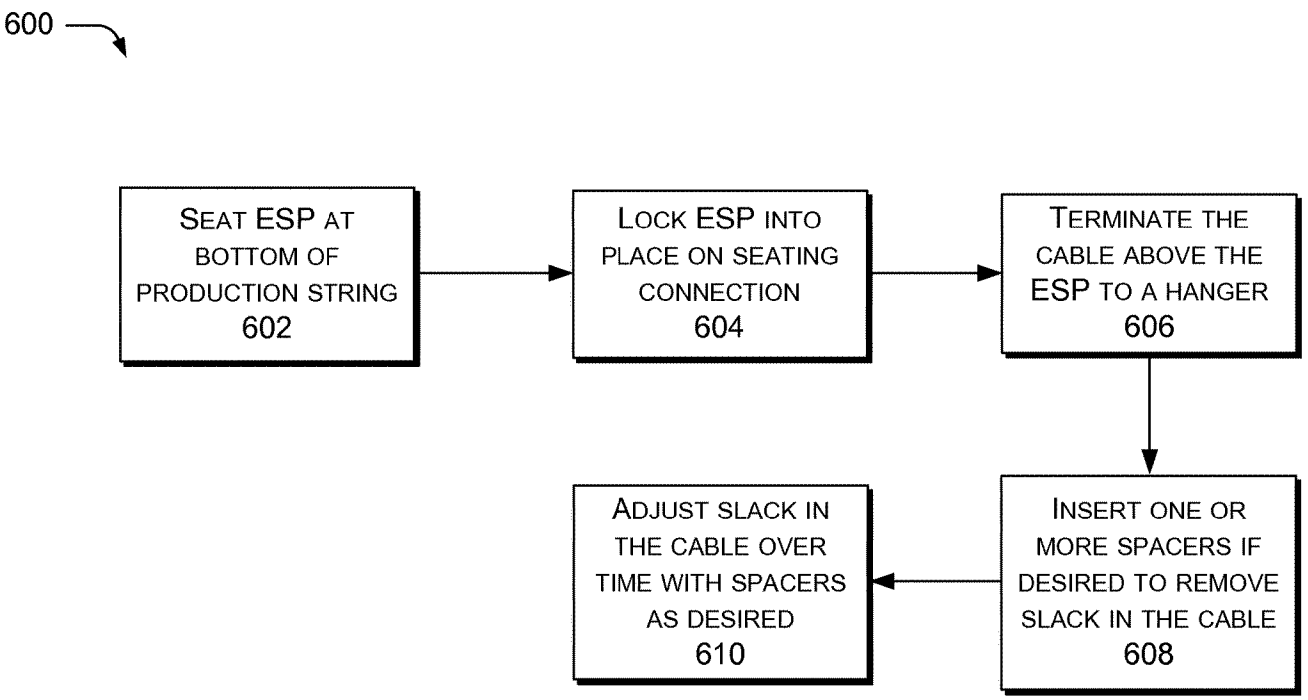
FIG. 6 is a flow diagram showing an example technique for seating an ESP, or other equipment, and for terminating a cable according to an embodiment.

In an example implementation, the system 100 may be used to seat the ESP 102 (or other device) into the wellbore 502, or other formation, as described in the flow chart of FIG. 6. For example, at block 602, the ESP 102 is lowered with the cable 104 by one or more of the injectors 106, until it seats (for example, at the bottom of the production string of a well 502). This seating of the ESP 102 is illustrated in FIG. 7.

At block 604, the ESP 102 may be locked into place at a seating connection, or the like, within the wellbore 502. For example, when the ESP 102 reaches a seating mechanism 702 at the bottom of the well 502 or production string, then in one implementation a load cell sensor (e.g., in a tool, etc.) detects a reduction in the weight being suspended by the cable 104, thereby indicating that the ESP 102 is in place at the sealing or seating mechanism 702 at the bottom of the production string. The ESP 102 is then locked into place on the seating connection 702.

Figure 7:
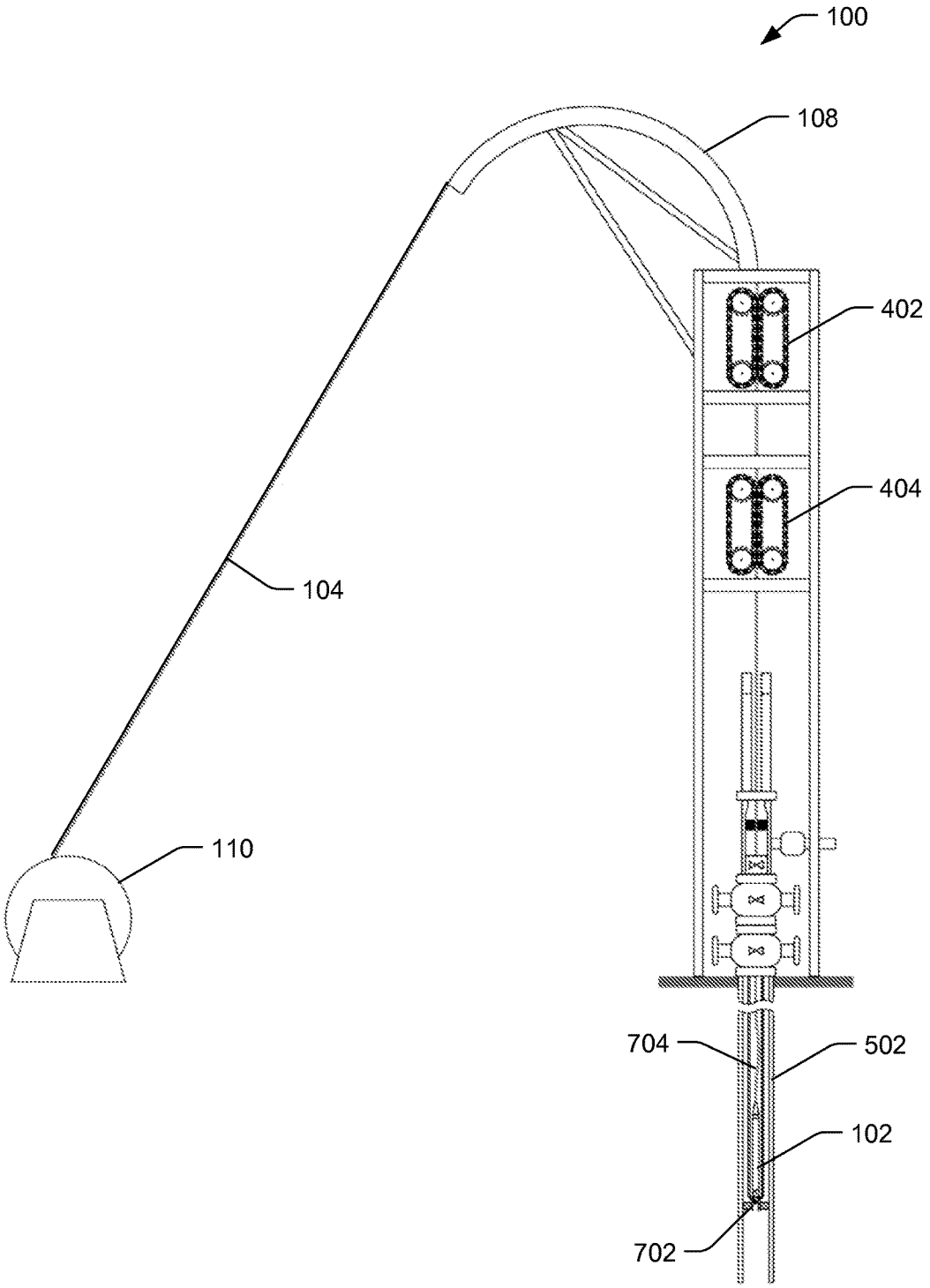
FIG. 7 is a diagram showing an example system for seating an ESP at a destination in a well.

As shown in FIG. 7, when the ESP 102 is seated, there may be some degree of slack (shown in FIG. 7 at 704) in the cable 104 line. If left in this state, the cable 104 could be subject to z-kinking, or the like. In an implementation, the load cell sensor (not shown) can continuously detect cable 104 tension and also compression. For example, in various embodiments, the load sensor may comprise one or more components including a mechanical or electronic force gauge, strain gauge, weight scale, force tester, or the like.

Figure 8:
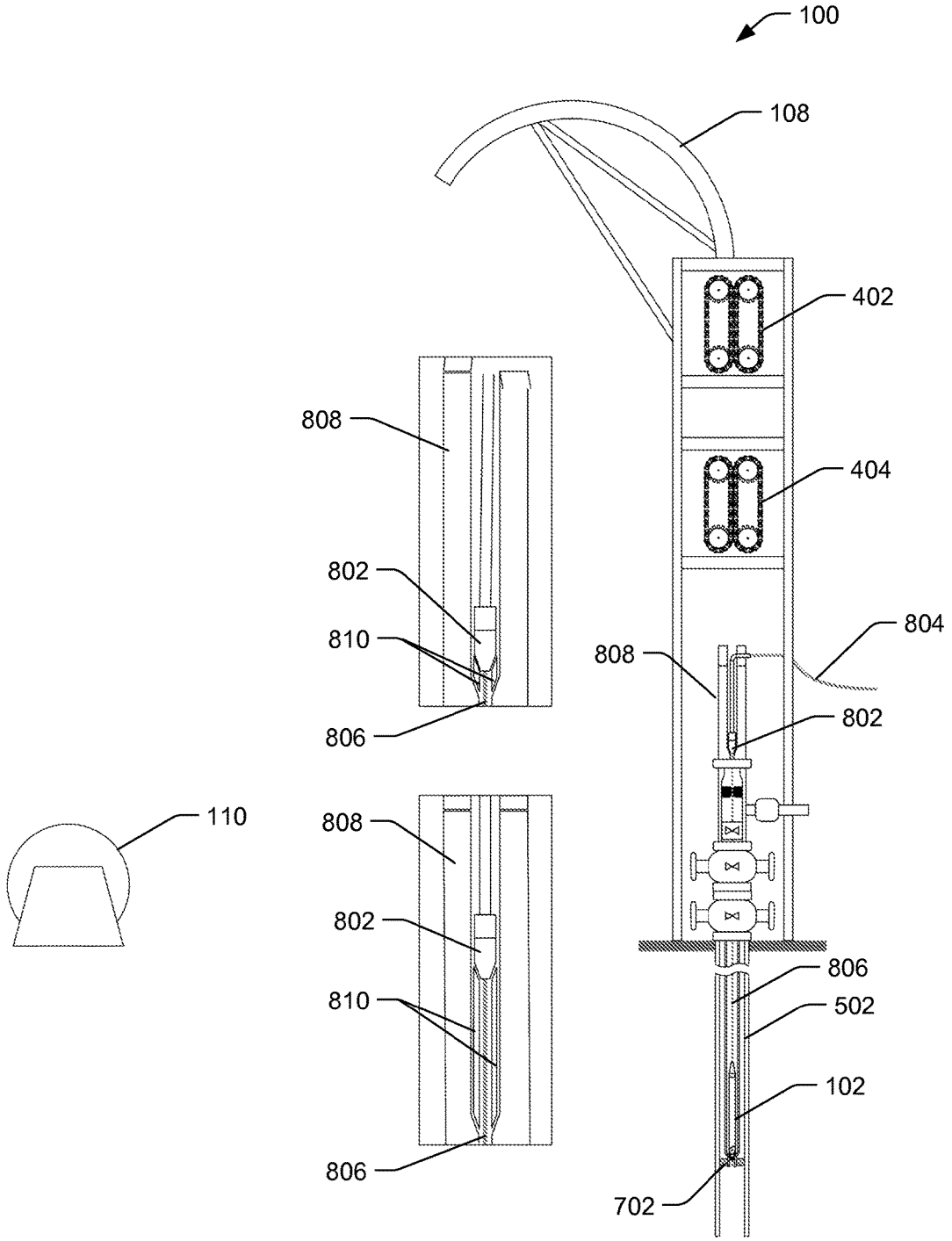
FIG. 8 is a diagram showing example ESP cable suspension techniques, and use of spacers to manage cable slack.

As shown in FIG. 8, and at block 606 (FIG. 6), the cable 104 is then terminated at a top termination 802 (forming a remaining lower cable length 806) to allow, for example, 50 lbs. or more of tension at the tool end (i.e., ESP end) to prevent the cable 806 from going into compression. In an example, the cable 104 is cut based on cable tension or compression data from the load cell. In various implementations, telemetry from the load cell is obtained by means of separate conductors (such as in a quad or a twisted-pair cable running between the main conductors 804), or can be obtained from one or more of the main conductors 804.

The ESP cable 806 is pulled taut to remove any slack present in the production string when the cable 806 is terminated to a cable hanger 808 at the surface. At block 608, inserts (e.g., spacers, etc.) 810 may be used in the cable hanger 808 to remove small amounts of slack from the cable 806 remaining after termination, or that develop over time. As depicted in FIG. 8 and shown at block 610, the length of the inserts 810 can be adjusted to take up varying amounts of slack (for example, a combined 3 to 4 feet of inserts 810 may be used in an implementation). Adjusting a length of the inserts 810 can include adding additional inserts 810 and using the combined length of the multiple inserts 810, replacing one or more inserts 810 with other inserts 810 (as depicted in FIG. 8, for example), as well as adjusting an actual length of one or more inserts 810, and the like.

In an implementation, the load cell at the bottom termination 702 can guide the process of managing slack in the cable 806 over time, sometimes completely. The load cell sensor can provide continuous data, including cable 806 tension or compression data, for example, allowing management of cable 806 slack throughout the deployment of the ESP 102 tool and during the operational life of the cable 806.

In an implementation, the system 100 includes a computing device 1600 (see FIG. 16) to direct a deployment of the ESP 102 or a retrieval of the ESP 102 based on data from the load sensor. In an implementation, the computing device 1600 receives data (i.e., weight, tension force value(s), etc.) from the load sensor. The data may be recorded or stored using one or more recording or storage devices 1604 (see FIG. 16), for instance. In various implementations, the computing system 1600 may be integrated with the load cell sensor, and so forth. Descriptions of example computing systems 1600 and associated components are given below, with reference to FIG. 16.

Example Retrieval

Figure 9:
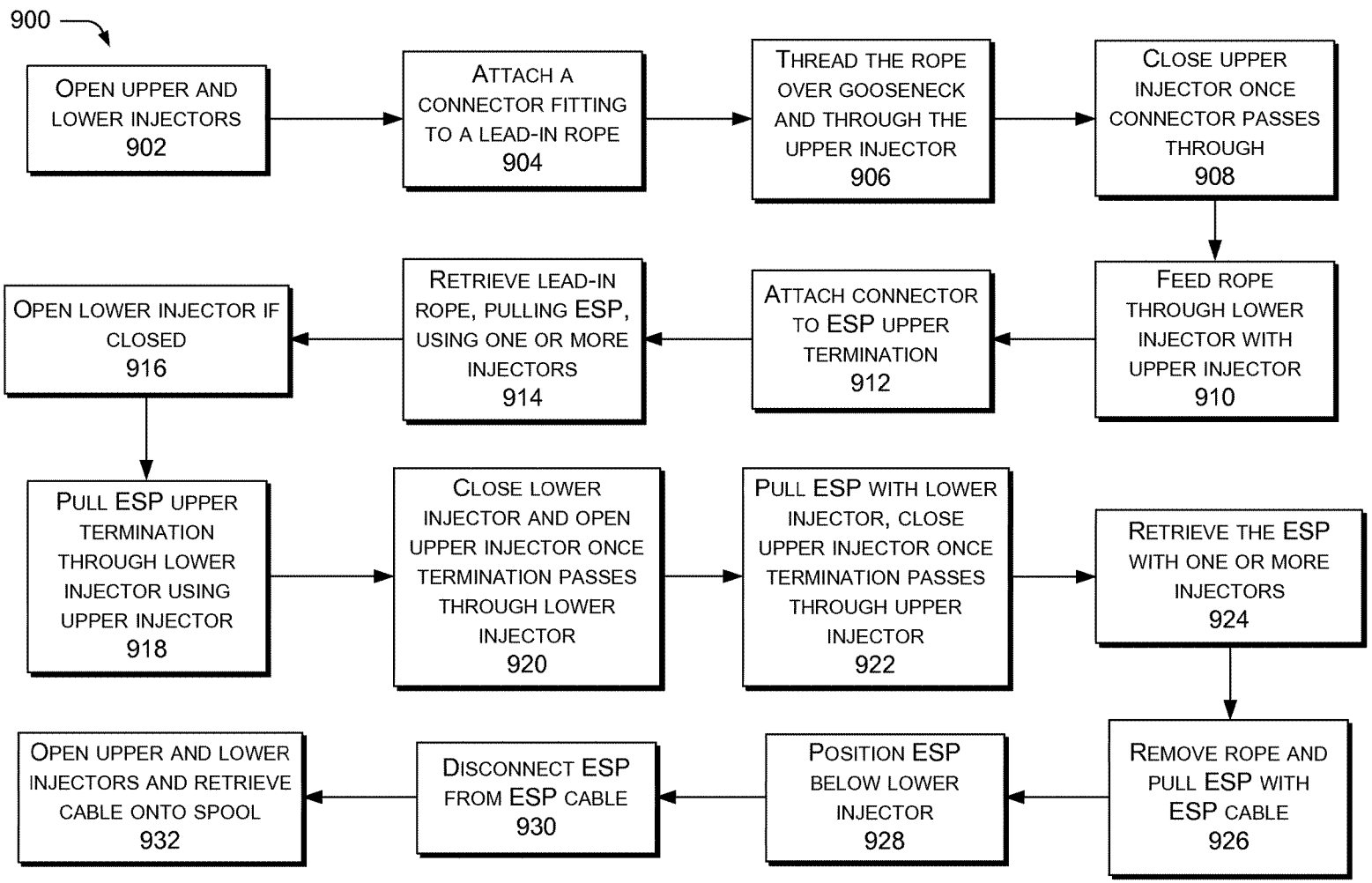
FIG. 9 is a flow diagram showing an example technique for retrieving an ESP, or other equipment, according to an embodiment.
Figure 10:
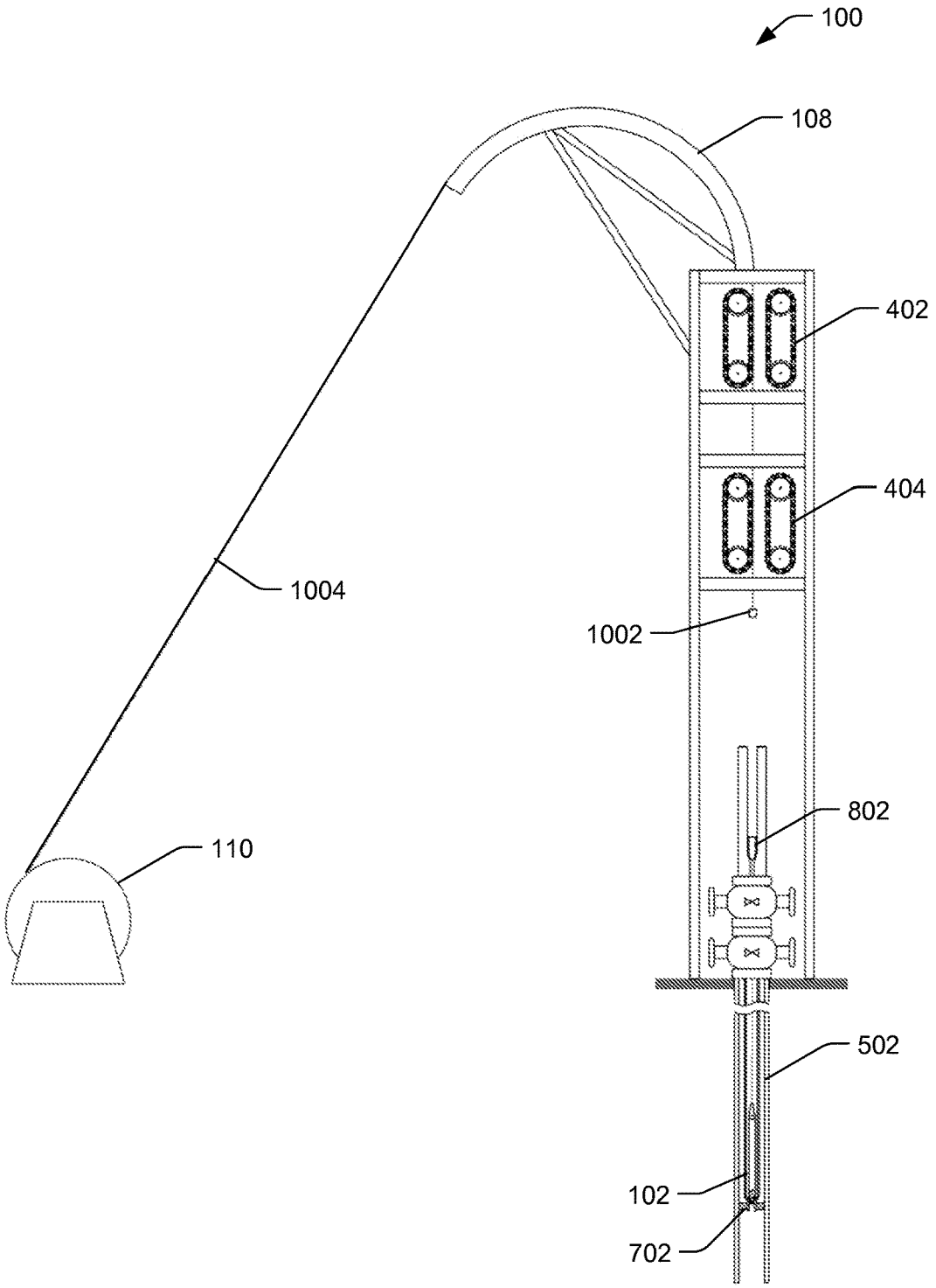
FIG. 10 is a diagram showing commencement of ESP retrieval using cable and tube injectors.

In an example implementation, a system 100 may be used to retrieve an ESP 102 (or other device) out or a well 502, or other formation, as described in the flow chart of FIG. 9. As shown in FIG. 9 at block 902, and in FIG. 10, the system injector(s) 106 (e.g., the upper 402 and lower 404 injectors) are opened to prepare for cable 104 insertion. In an example technique, at block 904, a connector 1002 is attached to a lead-in cable (or rope) 1004, and at 906, the rope 1004 is threaded from a spool 110, over the gooseneck 108 and through the opened upper 402 and lower 404 injectors. At block 908, the upper injector 402 may be closed once the connector 1002 on the lead-in cable 1004 has passed through, so that the upper injector 402 can help move the cable 1004 downward. At block 910, the cable 1004 advances until the connector 1002 is below the lower injector 404.

Figure 11:
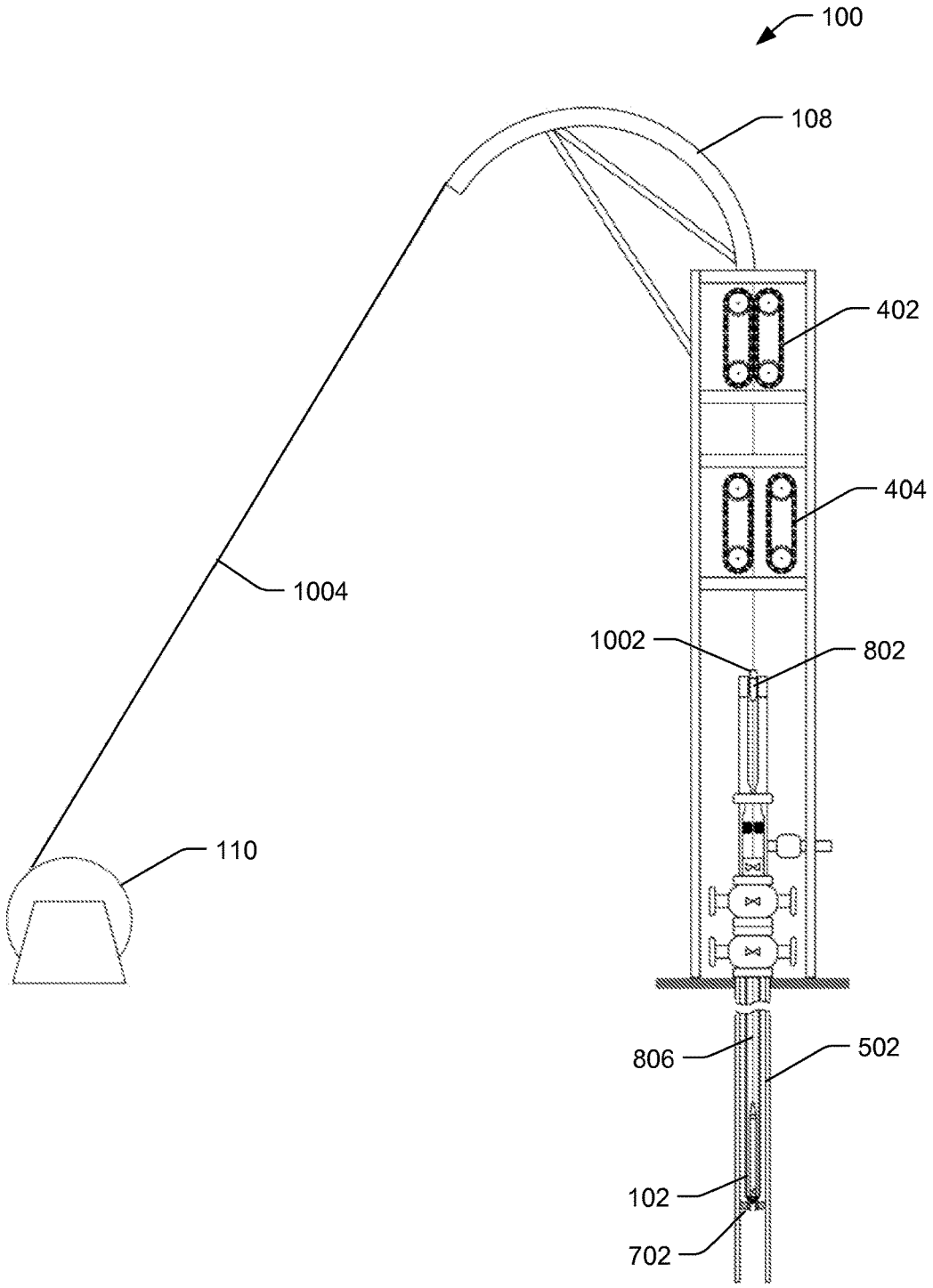
FIG. 11 is a diagram showing lead-in connection to a top cable termination of an installed ESP during ESP retrieval.

At block 912, and as shown in FIG. 11, the lead-in cable 1004 is connected to the upper termination 802 of the ESP cable 806. At block 914, the lead-in cable 1004 is retrieved onto the spool 110 using one or more of the injectors 106 (402, 404), pulling the ESP cable 806 from the well 502. Both injectors 106 can be closed and used to provide additional pulling force if needed to disengage a stuck ESP cable assembly, for example.

At block 916, the lower injector 404 is opened to allow the connection 1002 between the lead-in 1004 and the ESP cable 806 to pass through. The upper injector 402 can pull the ESP upper termination 1002 through the lower injector 404, for example, as described at block 918.

Figure 12:
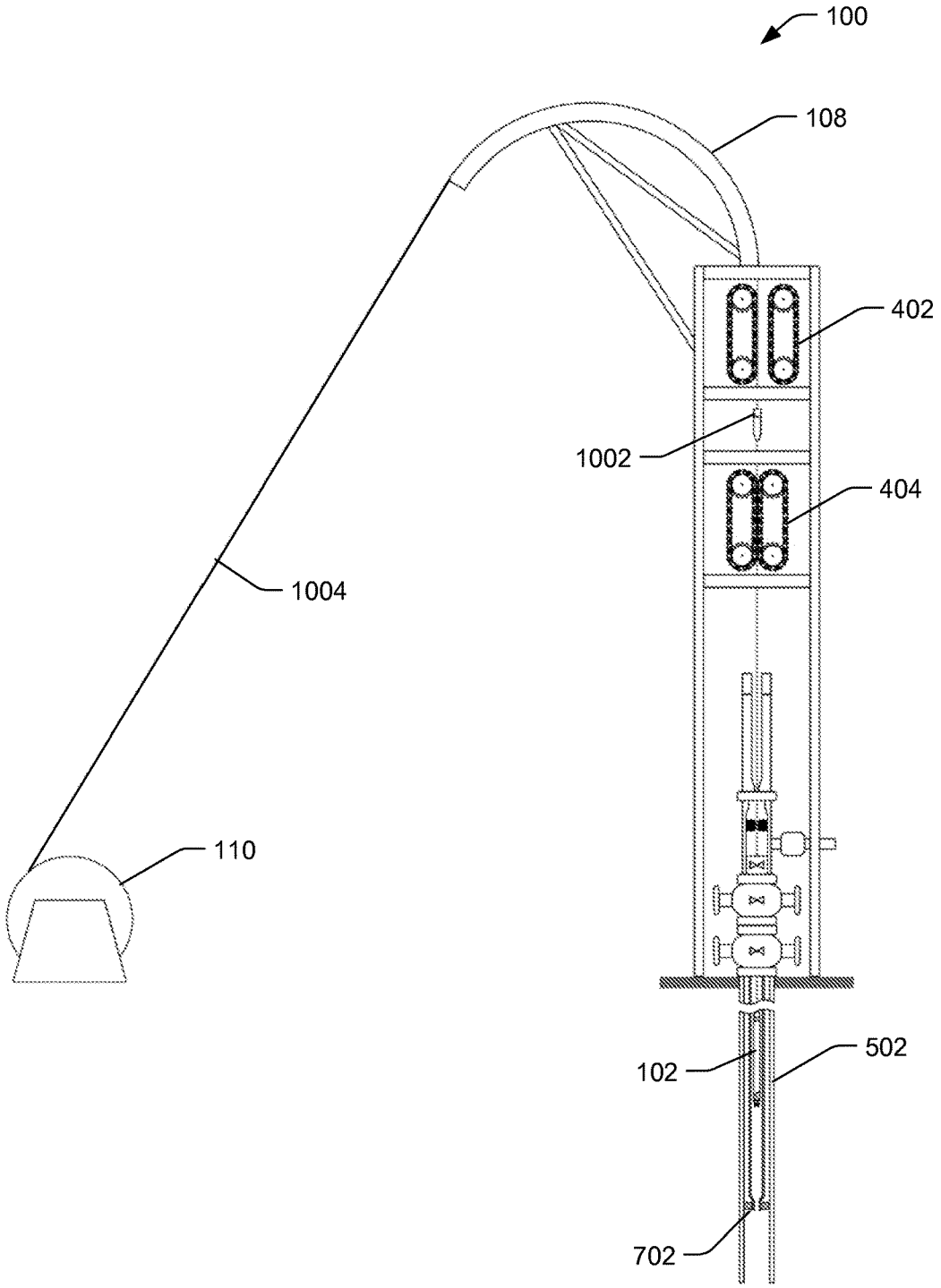
FIG. 12 is a diagram showing ESP retrieval via tube injectors outfitted to pull an ESP cable, with a lead-in connector passing through an open injector.
Figure 13:
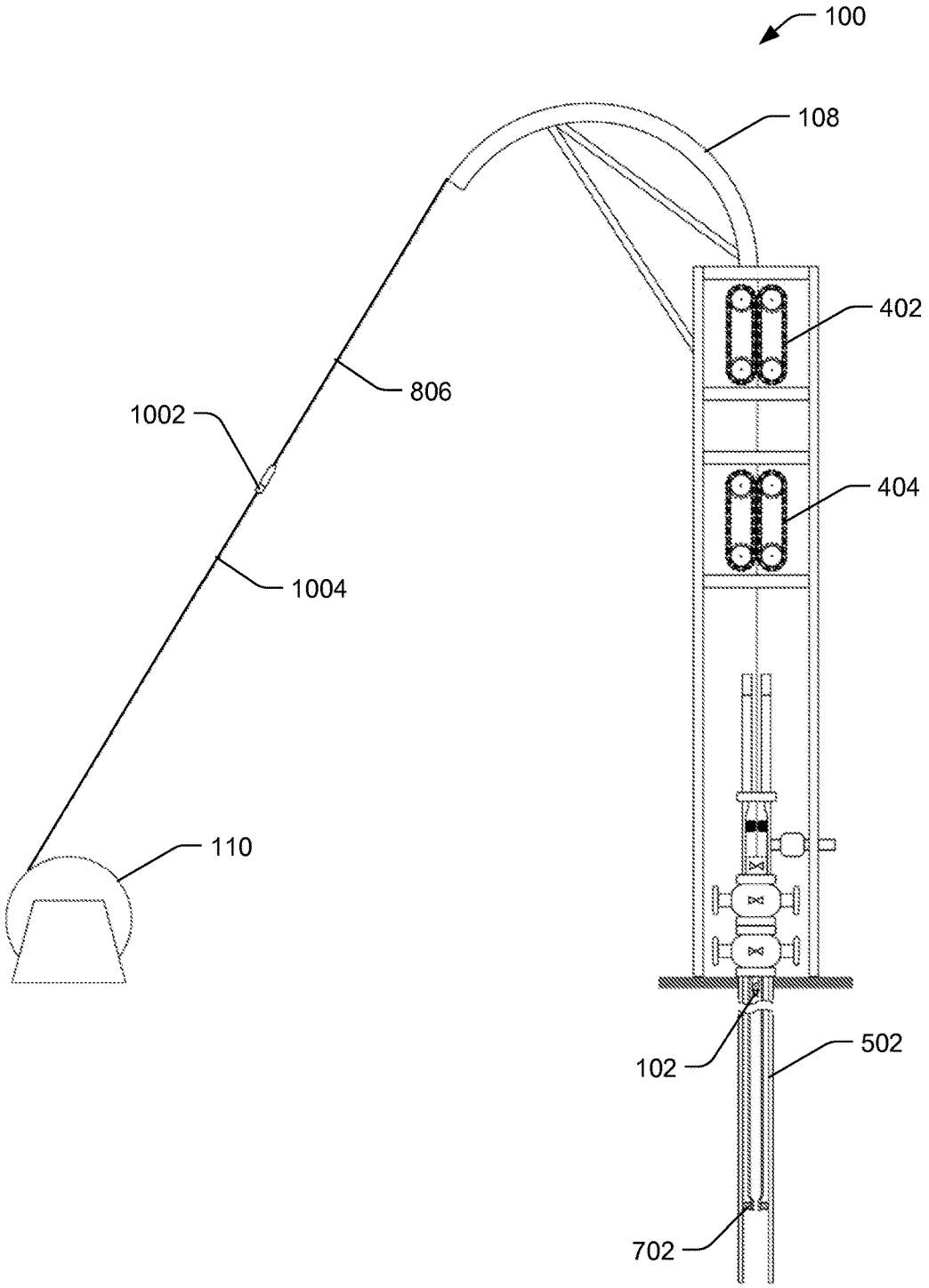
FIG. 13 is a diagram showing ESP retrieval via tube injectors outfitted to pull an ESP cable, with a lead-in connector cleared past through both injectors, and both injectors closed to pull the cable.

Once the connection 1002 has passed through the lower injector 404, the upper injector 402 is opened (at block 920 and illustrated in FIG. 12) to allow the connection 1002 to pass through. At block 922, the lower injector 404 can be closed and used to assist in retrieving the ESP cable 806 as the connection 1002 passes through the open, upper injector 402. Once the connection has passed through the upper injector 402, the upper injector 402 can also be closed again, and (at block 924) both injectors 402, 404 can be used to pull the ESP cable 806 and ESP 102 tool string out of the well 502, as illustrated in FIG. 13.

Figure 14:
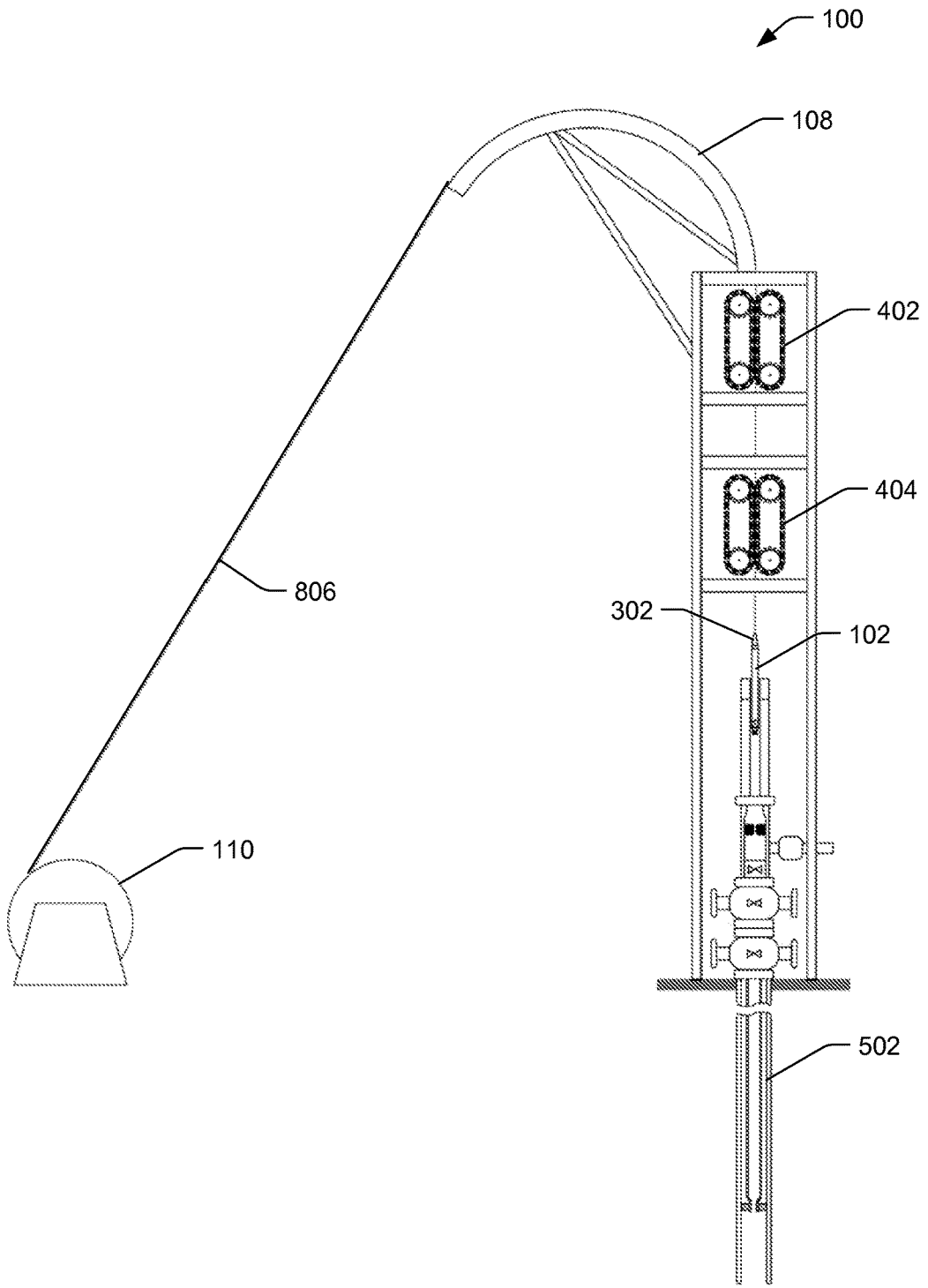
FIG. 14 is a diagram showing an ESP in position for disconnection during example ESP retrieval.

At block 926, the lead-in cable 1002 is then removed and the ESP cable 806 is connected to the spool 110. As shown in FIG. 14, the ESP cable 806 can be taken up onto the spool 110 until the ESP 102 tool string is in position below the lower injector 404 (at block 928), with both upper 402 and lower 404 injectors in the closed position or with the lower injector 404 closed and the upper injector 402 open.

Figure 15:
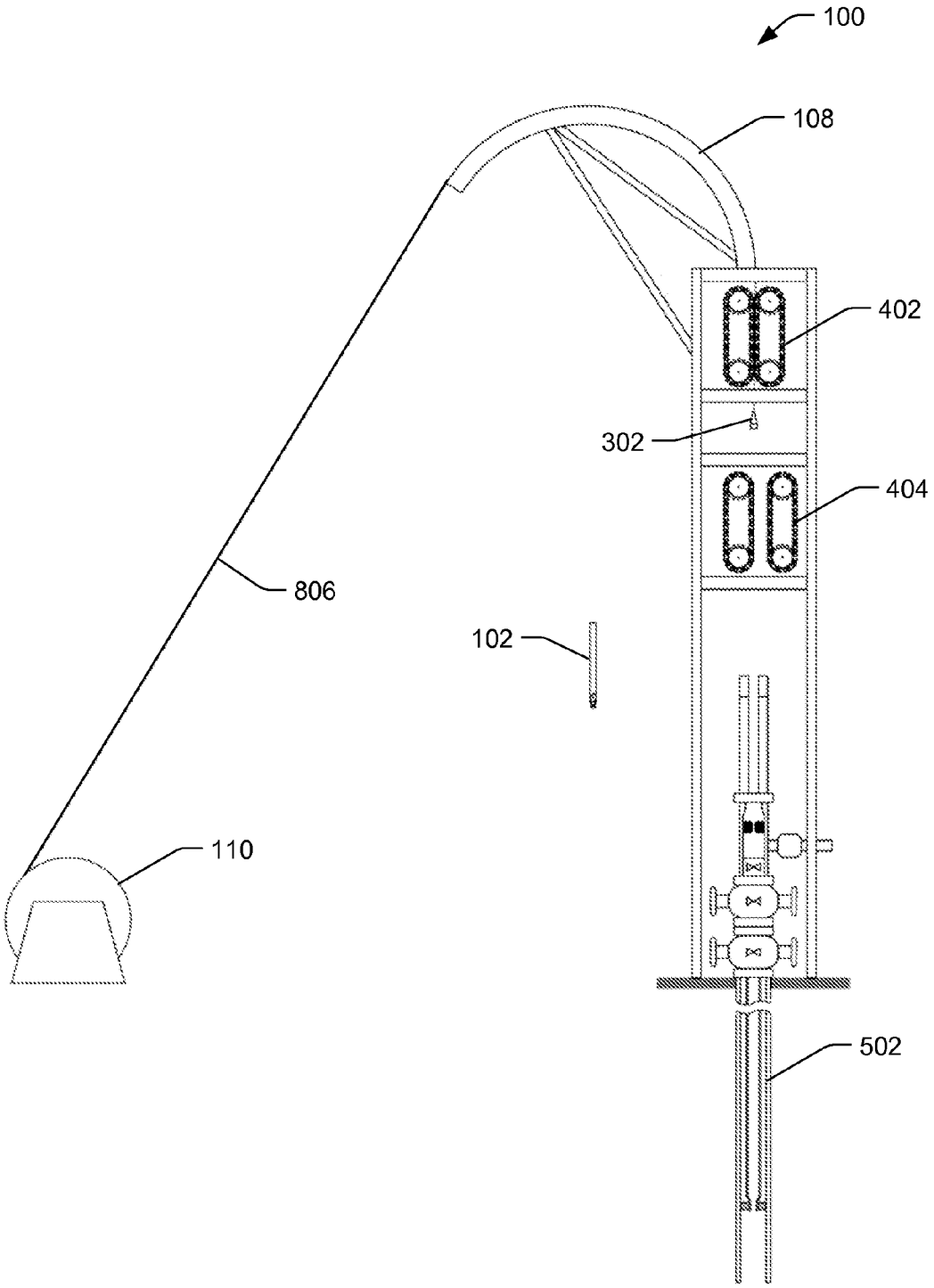
FIG. 15 is a diagram showing example ESP removal and an ESP cable connector passed through an open injector in the example ESP retrieval.

At block 930, and as shown in FIG. 15, the ESP 102 is disconnected from the ESP cable 806. Once the ESP 102 has been disconnected from the ESP cable, at block 932, the bottom injector 404 can be opened to allow the pre-terminated connector 302 to pass through. Likewise the upper injector 402 can be opened and the remainder of the ESP cable 806 can be retrieved onto the spool 110.

In various implementations, a system 100 may include fewer, additional, or alternate components, and remain within the scope of the disclosure. One or more components of a system 100 may be collocated, combined, or otherwise integrated with another component of the system 100. Further, one or more components of the system 100 may be remotely located from the other(s) of the components.

Load and Proximity Sensing and Telemetry

Figure 16:
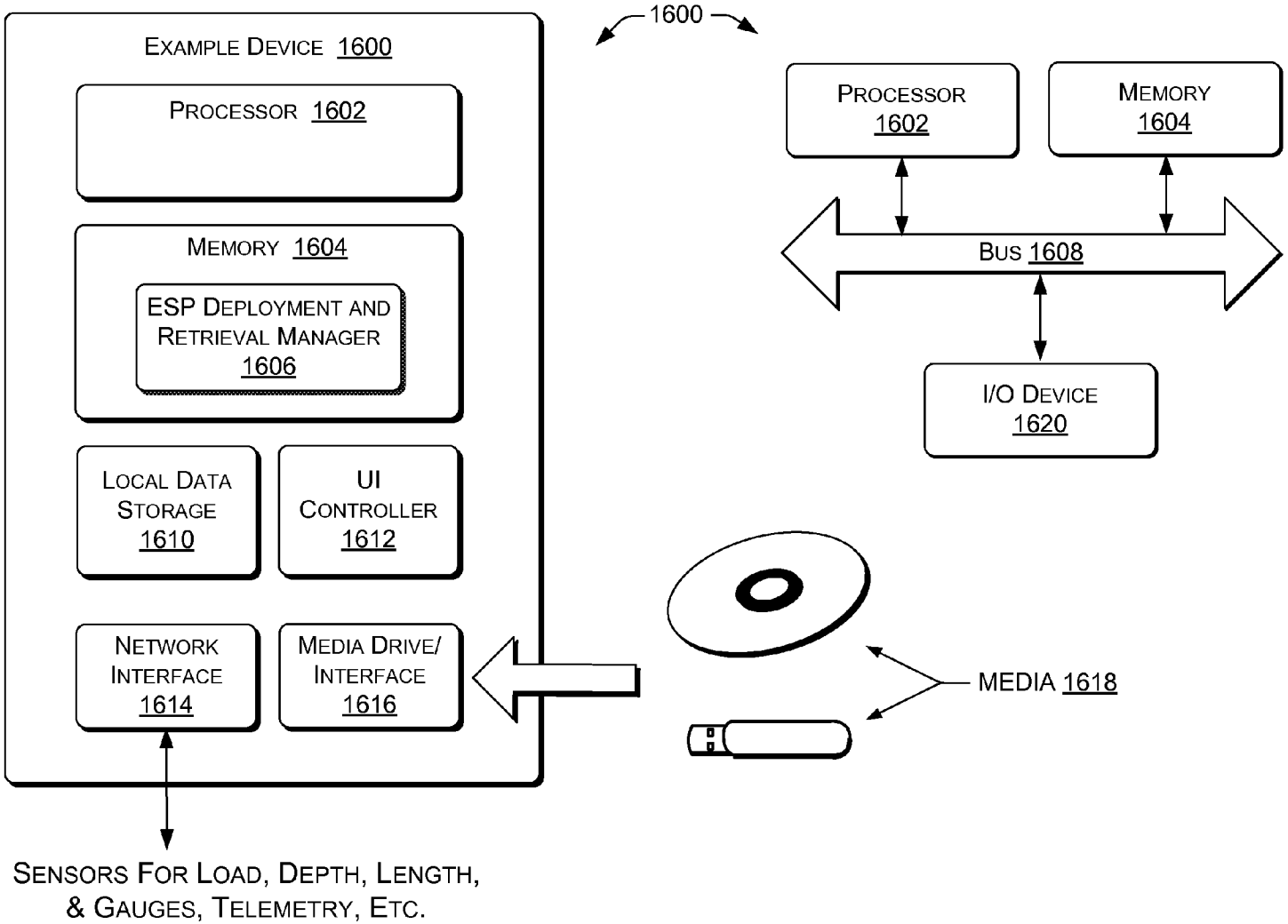
FIG. 16 is a block diagram of an example computing system for monitoring ESP loads, cable tension and compression, ESP position, and for executing telemetry for an ESP deployment and retrieval system, according to an embodiment.

FIG. 16 illustrates an example computing environment and device 1600 that can be implemented, for example, to manage deployment and retrieval of ESPs 102, to monitor loads, deployment depths, proximity between ESP 102 and seating location 702, cable (e.g., 104, 806, and 1004) tension and compression, and other parameters associated with using, deploying, and retrieving ESPs 102.

The example computing device 1600 with processor 1602 and memory 1604 has an ESP deployment and retrieval manager 1606 that can monitor and analyze data, provide control, and intervene when an ESP 102 is being deployed or retrieved by the systems and methods described herein. The example computing device 1600 is only one example of a computing device and is not intended to suggest any limitation as to scope of use or functionality of the computing device and/or its possible architectures. Neither should computing device 1600 be interpreted as having any dependency or requirement relating to any one or combination of components illustrated in the example computing device 1600.

Example device 1600 includes one or more processors or processing units 1602, one or more memory components 1604, the ESP deployment and retrieval manager 1606, a bus 1608 that allows the various components and devices to communicate with each other, and includes local data storage 1610, among other components.

Memory 1604 generally represents one or more volatile data storage media. Memory component 1604 can include volatile media, such as random access memory (RAM) or nonvolatile media, such as read only memory (ROM), flash memory, and so forth.

Bus 1608 represents one or more of any of several types of bus structures, including a memory bus or memory controller, a peripheral bus, an accelerated graphics port, and a processor or local bus using any of a variety of bus architectures. Bus 1608 can include wired and/or wireless buses.

Local data storage 1610 can include fixed media (e.g., RAM, ROM, a fixed hard drive, etc.) as well as removable media (e.g., a flash memory drive, a removable hard drive, optical disks, magnetic disks, and so forth).

A user interface device may also communicate via a user interface (UI) controller 1612, which may connect with the UI device either directly or through the bus 1608.

A network interface 1614 may communicate outside of the example device 1600 via a connected network, and in some implementations may communicate with hardware, such as sensors for load, depth, length, and with gauges and telemetry components. In other implementations, the sensors for load, depth, length, gauges, and telemetry components may communicate with the example device 1600 as input/output devices 1620 via the bus 1608 and via a USB port, for example.

A media drive/interface 1616 accepts removable tangible media 1618, such as flash drives, optical disks, removable hard drives, software products, etc. Logic, computing instructions, or a software program comprising elements of the ESP deployment and retrieval manager 1606 may reside on removable media 1618 readable by the media drive/interface 1616.

One or more input/output devices 1620 can allow a user to enter commands and information to example device 1600, and also allow information to be presented to the user and/or other components or devices. Examples of input devices 1620 include, in some implementations, sensors for load, depth, length; gauges and telemetry components, as well as keyboard, a cursor control device (e.g., a mouse), a microphone, a scanner, and so forth. Examples of output devices include a display device (e.g., a monitor or projector), speakers, a printer, a network card, actuators, solenoids, and so forth.

Various processes of the ESP deployment and retrieval manager 1606 may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer readable media. Computer readable media can be any available data storage medium or media that is tangible and can be accessed by a computing device. Computer readable media may thus comprise computer storage media.

"Computer storage media" designates tangible media, and includes volatile and non-volatile, removable and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

In various implementations, the computing device 1600 may be fully integrated with the system 100, or may have some components separate or remote from components of the system 100. For example, some processing for the computing device 1600 may be located remotely (e.g., cloud, network, etc.). In another example, some outputs from the computing device 1600 may be transmitted, displayed, or presented on a remote device or at a remote location.

The techniques, components, and devices described herein with respect to a system 100 or its various components are not limited to the illustrations in FIGS. 1-16, and may be applied to other systems, designs, and/or applications without departing from the scope of the disclosure. In some cases, additional or alternative components may be used to implement the techniques described herein. It is to be understood that a system 100 may be stand-alone, or may be part of another system (e.g., integrated with other components, systems, etc.).

Representative Process

Figure 17:
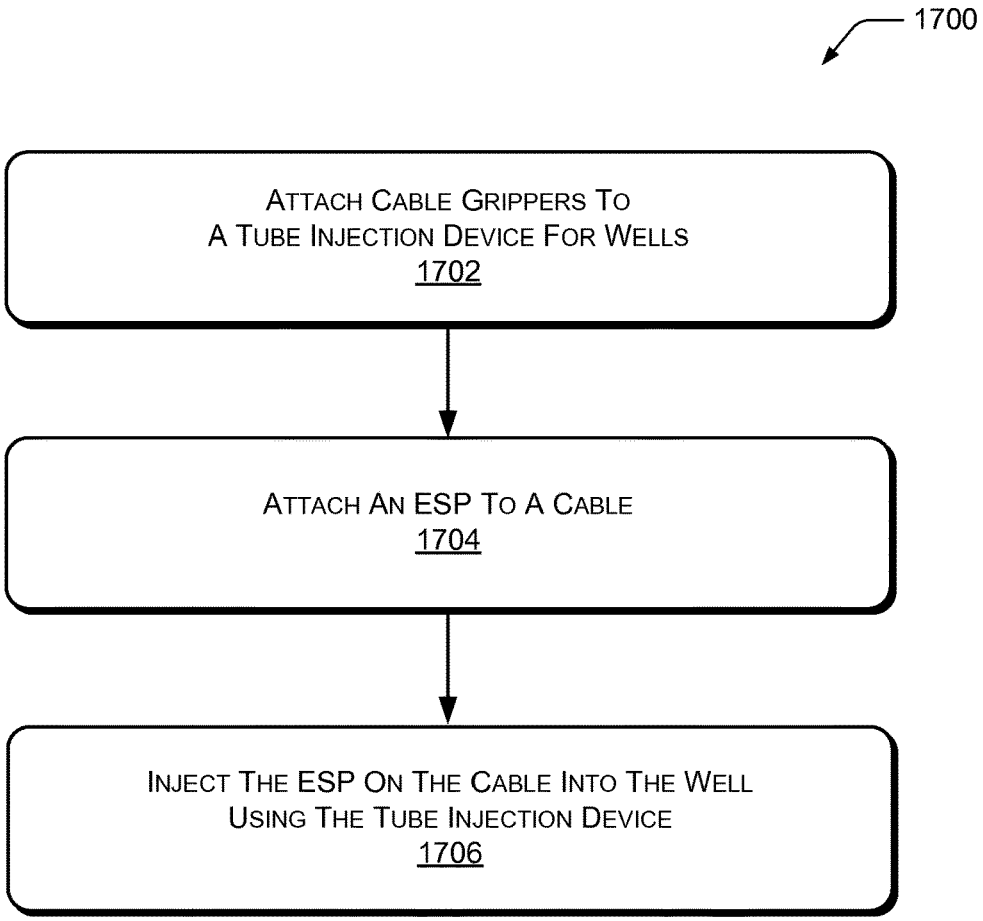
FIG. 17 is flow diagram of an example method of using a tube injector to deploy an ESP on a cable, in accordance with one or more embodiments.

FIG. 17 illustrates a representative process 1700 for using a tube injector (such as an injector 106, for example) to deploy an ESP (or other device) on a cable, in accordance with one or more varied embodiments. The process 1700 is described with reference to FIGS. 1-16.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable materials, or combinations thereof, without departing from the scope of the subject matter described herein.

At block 1702, the process includes attaching cable grippers (such as gripper blocks 304, for example) to a tube injection device (such as an injector 106, for example) for a well. In an implementation, the cable grippers are arranged to reduce a gripping diameter of each injection device from a first gripping diameter suitable for coiled tubing to a second gripping diameter suitable for a desired cable.

In an embodiment, the process includes terminating the cable at one end or at both ends of the cable prior to deploying the cable with the tube injection device. For example, in pre-terminating the cable, a connector may be attached to an end of the cable, for connecting equipment (such as an ESP, for example) to the cable.

At block 1704, the process includes attaching an ESP (such as an ESP 102, for example), or other device to a cable (such as cable 104, for example). In an implementation, the ESP is field-connected to the cable via the connector at the termination of the cable.

At block 1706, the process includes injecting the ESP on the cable into the well using the tube injection device. In an embodiment, the process includes injecting the ESP into the well using a plurality of tube injection devices arranged to open and close in a coordinated manner, allowing an oversized component (such as the connector, for example) attached to the cable to pass through an open tube injection device while a closed tube injection device grips the cable. In this manner, at least one injection device can maintain gripping the cable, and conveying the cable and the ESP, while other injection devices are opened to allow the oversized component(s) to pass through.

In an implementation, the process includes reducing a stress on the cable at one or more bends of the cable via the tube injection device. For example, in one embodiment, the process includes passing the cable over a gooseneck portion that is arranged to distribute the forces on the cable (due to the weight of the ESP, etc.) over a large section of the cable, prior to inserting the cable into the injection device. In another embodiment, the injection device is arranged such that the weight of the ESP is borne by the cable in a vertical orientation. In these and other embodiments, the techniques described reduce or eliminate concentrated stress on the cable at discrete points, which can cause cable failure.

In an embodiment, the process includes sensing a tension or a compression of the cable to prevent kinking of control lines and power lines. For instance, a load cell sensor, or the like, may output tension or compression data regarding the cable, which may allow techniques to be employed to reduce slack in the cable, thereby preventing kinking of the control and power lines. For example, spacers may be inserted at desired locations along the length of the cable (at points where the cable is fixed, for instance) to reduce slack in the cable.

In another embodiment, the process includes sensing a tension or a compression of the cable to determine a seating position for the ESP. For example, a reduction in the tension or an increase in the compression of the cable can indicate the ESP making contact with a fixed seat. In an implementation, locking mechanisms at a seat position may be triggered based on cable tension or compression data.

In an implementation, the process includes cutting the cable to a desired length based on the cable tension or the cable compression sensed. For example, in various implementations, the cable may be cut when the ESP is seated for production. The cutting may be triggered by a change in cable tension and/or compression. In one example, the cable cutting may be arranged to occur when compression just begins to increase (tension decrease), such that slack in the cable is minimized after cutting.

In alternate implementations, other techniques may be included in the process 1700 in various combinations, and remain within the scope of the disclosure.

CONCLUSION

Although only a few example embodiments have been described in detail above, those skilled in the art will readily appreciate that many modifications are possible in the example embodiments without materially departing from a deployment and retrieval system. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112 (f) for any limitations of any of the claims herein, except for those in which the claim expressly uses the words 'means for' together with an associated function.

What is claimed is:

1. A system, comprising:

a cable suitable for raising and lowering an electric submersible pump (ESP) in a well;

at least a first coiled tubing injector having a coiled tubing gripping diameter configured for lowering and raising coiled tubing in the well;

a first gripper attached to the first coiled tubing injector and having a cable gripping diameter configured for lowering and raising the cable in the well;

a load sensor configured to continuously determine a tension of the cable or to determine a weight acting on the cable; and one or more spacers arranged to remove slack from the cable while the ESP is seated within a wellbore, the one or more spacers deployed based on the tension of the cable determined by the load sensor.

2. The system of claim 1, further comprising at least a second coiled tubing injector positioned under the first coiled tubing injector, and a second gripper attached to the second coiled tubing injector for lowering and raising the cable; and wherein when a connector, load, or other member attached to the cable is too large to pass through the gripper, then one of the coiled tubing injectors opens to allow the connector, load, or other member to pass through the respective gripper, while at least another coiled tubing injector grips the cable and raises or lowers the cable.

3. The system of claim 2, wherein each coiled tubing injector has an openable mechanism for the respective gripper to allow the connector, load, or other member to temporarily pass through a given coiled tubing injector when the openable mechanism of the coiled tubing injector is open.

4. The system of claim 1, further comprising a connector attached to the cable for releasably securing at least a component of the ESP.

5. The system of claim 1, further comprising a power source connected to each coiled tubing injector for either lowering the cable into a wellbore to install at least a component of the ESP or for raising the cable from the wellbore to retrieve at least a component of the ESP.

6. The system of claim 1, wherein the load sensor monitors a tension or a compression of the cable during ESP deployment or ESP retrieval.

7. The system of claim 1, further comprising a computing device to direct a deployment of the ESP or a retrieval of the ESP based on data from the load sensor.

8. The system of claim 1, further comprising a cable hanger.

9. A method, comprising:

providing a tube injection device having a coiled tubing gripping diameter configured to lower and raise coiled tubing into a well;

attaching cable grippers to the tube injection device, wherein the cable grippers each have a cable gripping diameter configured to lower and raise a cable into the well;

attaching an ESP to the cable;

injecting the ESP on the cable into the well using the cable grippers attached to the tube injection device;

determining a tension or a compression of the cable via a load sensor; and arranging one or more spacers to remove slack from the cable while the ESP is seated within the well based on the tension or compression determined by the load sensor.

10. The Method of claim 9, further comprising: maintaining an amount of tension or compression on the cable to prevent a kinking of control lines and power lines based on the sensed tension or compression.

11. The method of claim 9, further comprising: determining a seated position for the ESP based on the sensed tension or compression.

12. The method of claim 11, further comprising cutting the cable to a desired length based on the sensed tension or compression.

13. The method of claim 9, further comprising terminating the cable at one end or at both ends of the cable prior to deploying the cable with the tube injection device.

14. The method of claim 13, further comprising injecting the ESP into the well using a plurality of tube injection devices arranged to open and close in a coordinated manner, allowing an oversized component attached to the cable to pass through an open tube injection device while a closed tube injection device grips the cable.

15. The method of claim 9, further comprising reducing a stress on the cable at one or more bends of the cable via the tube injection device.

16. The method of claim 9, further comprising sensing a tension or a compression of the cable and arranging the one or more spacers based on the sensed tension or compression.

17. The method of claim 16, further comprising adjusting the one or more spacers over time as needed.

18. A system, comprising:

a cable suitable for raising and lowering a load in a well;

first and second coiled tubing injectors, the first and second coiled tubing injectors disposed in tandem above a well and each having a coiled tubing gripping diameter configured to lower and raise coiled tubing in the well;

gripper blocks attached to a feeding mechanism of each coiled tubing injector, the gripper blocks each having a cable gripping diameter configured for modifying each coiled tubing injector to grip the cable instead of the coiled tubing;

a gripping mechanism on each coiled tubing injector to open the gripper blocks from the cable or to close the gripper blocks on the cable;

one or more spacers disposed in a cable hanger at the surface and configured to be arranged to remove slack from the cable once the load is seated in the well;

a power source for each coiled tubing injector for animating the coiled tubing injectors to raise or lower the cable;

a computer in communication with the power sources and the gripping mechanisms; and instructions residing on a tangible data storage medium of the computer, which when executed by the computer cause the coiled tubing injectors to raise or lower the cable and to open and close the gripping mechanisms of the tandem coiled tubing injectors in a sequence that allows an obstacle on the cable to pass through both of the coiled tubing injectors.

19. The system of claim 18, further comprising a load sensor to determine a tension of the cable, wherein the computer maintains an amount of tension on the cable based on the sensed tension to prevent a kinking of communication cables and power cables associated with the cable.

20. The system of claim 19, wherein the load sensor and the computer calculate a length of cable deployed in the well based on the sensed tension in order to seat the load at a bottom or a destination in the well.

* * * * *